US011673222B2

(12) United States Patent
Watanabe et al.

(10) Patent No.: US 11,673,222 B2
(45) Date of Patent: Jun. 13, 2023

(54) POLISHING HEAD SYSTEM AND POLISHING APPARATUS

(71) Applicant: EBARA CORPORATION, Tokyo (JP)

(72) Inventors: Katsuhide Watanabe, Tokyo (JP); Itsuki Kobata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 117 days.

(21) Appl. No.: 17/206,652

(22) Filed: Mar. 19, 2021

(65) Prior Publication Data

US 2021/0308823 A1 Oct. 7, 2021

(30) Foreign Application Priority Data

Mar. 26, 2020 (JP) ..... JP2020-056240

(51) Int. Cl.

| | |
|---|---|
| ***B24B 37/10*** | (2012.01) |
| ***B24B 49/04*** | (2006.01) |
| ***B24B 37/32*** | (2012.01) |
| ***B24B 37/013*** | (2012.01) |

(52) U.S. Cl.

CPC ..... *B24B 37/105* (2013.01); *B24B 37/013* (2013.01); *B24B 37/32* (2013.01); *B24B 49/04* (2013.01)

(58) Field of Classification Search

None

See application file for complete search history.

(56) References Cited

U.S. PATENT DOCUMENTS

| | | | | |
|---|---|---|---|---|
| 5,868,896 | A * | 2/1999 | Robinson | B24B 49/16 438/959 |
| 5,888,120 | A * | 3/1999 | Doran | B24B 37/005 451/287 |
| 5,997,384 | A * | 12/1999 | Blalock | B24B 21/004 451/287 |
| 6,110,025 | A * | 8/2000 | Williams | B24B 49/16 451/286 |
| 6,143,123 | A * | 11/2000 | Robinson | B24B 37/013 156/934 |
| 6,203,414 | B1 * | 3/2001 | Numoto | B24B 37/30 451/288 |
| 6,242,353 | B1 * | 6/2001 | Kobayashi | B24B 37/32 438/692 |
| 6,290,584 | B1 * | 9/2001 | Kim | B24B 53/017 451/288 |

(Continued)

FOREIGN PATENT DOCUMENTS

| | | |
|---|---|---|
| JP | H09-225820 A | 9/1997 |
| JP | H10-128655 A | 5/1998 |

(Continued)

*Primary Examiner* — Don M Anderson
*Assistant Examiner* — Jonathan R Zaworski
(74) *Attorney, Agent, or Firm* — BakerHostetler

(57) ABSTRACT

A polishing head system capable of precisely controlling a pressing force of a retainer member, such as a retainer ring, against a polishing pad. The polishing head system includes: a polishing head including an actuator configured to apply a pressing force to the workpiece, a retainer member arranged outside the actuator, and piezoelectric elements coupled to the retainer member; and a drive-voltage application device configured to apply voltages independently to the piezoelectric elements.

21 Claims, 9 Drawing Sheets

(56) References Cited

U.S. PATENT DOCUMENTS 6,325,696 B1 * 12/2001 Boggs ..... B24B 49/16 451/6
6,443,821 B1 * 9/2002 Kimura ..... B24B 37/32 451/41
6,458,015 B1 * 10/2002 Robinson ..... B24B 37/013 451/41
6,558,232 B1 * 5/2003 Kajiwara ..... B24B 49/16 451/41
6,579,151 B2 * 6/2003 Tseng ..... B24B 37/32 451/287
6,776,695 B2 * 8/2004 Owczarz ..... B24B 21/04 451/299
6,863,771 B2 * 3/2005 Brown ..... B24B 1/005 451/41
7,048,621 B2 * 5/2006 Chen ..... B24B 37/005 451/398
7,150,673 B2 * 12/2006 Sakurai ..... B24B 37/005 451/5
7,160,177 B2 * 1/2007 Herold ..... B24B 49/16 451/380
7,285,037 B2 * 10/2007 Brown ..... B24B 37/30 451/388
7,357,695 B2 * 4/2008 Elledge ..... B24B 49/16 451/21
7,446,456 B2 * 11/2008 Maruyama ..... H01L 41/083 310/317
7,942,063 B2 * 5/2011 Gao ..... B23B 29/125 73/760
7,967,660 B2 * 6/2011 Fukuda ..... B24B 37/005 451/63
8,083,571 B2 * 12/2011 Nabeya ..... B24B 49/18 451/10
8,100,743 B2 * 1/2012 Nabeya ..... B24B 37/32 451/286
9,358,658 B2 * 6/2016 Chang ..... B24B 37/005
9,559,286 B2 * 1/2017 Wuerfel ..... H02N 2/02
9,878,421 B2 * 1/2018 Yavelberg ..... B24B 49/16
10,569,381 B2 * 2/2020 Yoshida ..... B24B 37/013
10,665,487 B2 * 5/2020 Kobata ..... H01L 21/30612
2008/0146119 A1 * 6/2008 Sasaki ..... B24B 37/30 451/514
2009/0311945 A1 * 12/2009 Strasser ..... B24B 37/32 451/364
2014/0357164 A1 12/2014 Nabeya et al.
2015/0017880 A1 * 1/2015 Nomura ..... H01L 22/26 451/6
2018/0286717 A1 * 10/2018 Watanabe ..... B24B 37/046

FOREIGN PATENT DOCUMENTS

JP 2000-246628 A 9/2000
JP 2017-047503 A 3/2017

* cited by examiner

POLISHING HEAD SYSTEM AND POLISHING APPARATUS

CROSS REFERENCE TO RELATED APPLICATION

This document claims priority to Japanese Patent Application No. 2020-056240 filed Mar. 26, 2020, the entire contents of which are hereby incorporated by reference.

BACKGROUND

In manufacturing of semiconductor devices, various types of films are formed on a wafer. In forming steps for interconnects and contacts, the wafer is polished after the film forming step in order to remove unnecessary portions of the film and surface irregularities. Chemical mechanical polishing (CMP) is a typical technique for wafer polishing. This CMP is performed by rubbing the wafer against a polishing surface while supplying a polishing liquid onto the polishing surface. The film formed on the wafer is polished by a combination of a mechanical action of abrasive grains contained in the polishing liquid or a polishing pad and a chemical action of chemical components of the polishing liquid.

During polishing of the wafer, the surface of the wafer is placed in sliding contact with the rotating polishing pad, and as a result, a frictional force acts on the wafer. Therefore, in order to prevent the wafer from coming off the polishing head during polishing of the wafer, the polishing head has a retainer member, such as a retainer ring (see Japanese laid-open patent publication No. 2017-047503). The retainer ring is arranged so as to surround the wafer. During polishing of the wafer, the retainer ring rotates and presses the polishing pad at the outside the wafer.

The retainer ring is provided not only to prevent the wafer from coming off the polishing head during polishing of the wafer, but also to cause deformation of a part of the polishing pad near the edge portion of the wafer by pressing the polishing pad. This pad deformation causes a change in a contact state between the wafer and the polishing pad at the edge portion of the wafer, so that a polishing rate of the edge portion of the wafer is controlled. Specifically, when the retainer ring is strongly pressed against the polishing pad, a part of the polishing pad is raised at the edge portion of the wafer, and this raised portion pushes the edge portion of the wafer upward. As a result, a polishing pressure on the edge portion of the wafer increases. In this way, the polishing rate of the edge portion of the wafer can be controlled by the pressing force of the retainer ring against the polishing pad.

However, during polishing of the wafer, the retainer ring is tilted due to the friction between the retainer ring and the polishing pad, and the circumferential distribution of the pressing force of the retainer ring against the polishing pad becomes non-uniform. As a result, the contact state between the polishing pad at the edge portion of the wafer and the surface of the wafer becomes non-uniform, and a polishing-rate distribution in the circumferential direction of the edge portion of the wafer becomes non-uniform. Furthermore, due to wear of the retainer ring itself, the circumferential distribution of the pressing force of the retainer ring against the polishing pad may also become non-uniform.

SUMMARY OF THE INVENTION

Therefore, there is provided a polishing head system capable of precisely controlling a pressing force of a retainer member, such as a retainer ring, against a polishing pad in a circumferential direction of the retainer member. There is further provided a polishing apparatus including such a polishing head system.

Embodiments, which will be described below, relate to a polishing head system configured to press a workpiece, such as a wafer, a substrate, or a panel, against a polishing surface of a polishing pad to polish the workpiece. Embodiments, which will be described below, also relate to a polishing apparatus including such a polishing head system.

In an embodiment, there is provided a polishing head system for polishing a workpiece having a film, to be processed, by relatively moving the workpiece and a polishing surface in the presence of a polishing liquid while pressing the workpiece against the polishing surface, comprising: a polishing head including an actuator configured to apply a pressing force to the workpiece, a retainer member arranged outside the actuator, and first piezoelectric elements coupled to the retainer member; and a drive-voltage application device configured to apply voltages independently to the first piezoelectric elements.

In an embodiment, the retainer member comprises retainer members coupled to the first piezoelectric elements, respectively.

In an embodiment, the polishing head system further comprises a retainer-member moving device configured to move an entirety of the first piezoelectric elements and the retainer member toward the polishing surface.

In an embodiment, the retainer-member moving device includes an elastic bag forming a first pressure chamber therein and a first gas supply line communicating with the first pressure chamber.

In an embodiment, the polishing head further includes coupling members coupled to the first piezoelectric elements, respectively, and end surfaces of the coupling members are coupled to the retainer member.

In an embodiment, the polishing head further includes a first holding member configured to limit a range of movement of the coupling members in a direction perpendicular to a direction of pressing the retainer member.

In an embodiment, the polishing head further includes pressing-force measuring devices configured to measure pressing forces generated by the first piezoelectric elements.

In an embodiment, the pressing-force measuring devices are arranged between the first piezoelectric elements and the coupling members, respectively.

In an embodiment, the polishing head further includes a voltage distributor electrically coupled to the drive-voltage application device and the first piezoelectric elements, the voltage distributor being configured to distribute the voltage applied from the drive-voltage application device to the first piezoelectric elements.

In an embodiment, the actuator comprises a fluid-pressure type actuator, the fluid-pressure type actuator including an elastic membrane configured to form second pressure chambers and arranged to contact the back surface of the workpiece, and second gas supply lines communicating with the second pressure chambers, respectively.

In an embodiment, the actuator comprises second piezoelectric elements which are arranged so as to apply pressing forces to multiple regions of the workpiece.

In an embodiment, the polishing head further includes pressing members coupled to the second piezoelectric elements, respectively.

In an embodiment, the polishing head further includes a second holding member configured to limit a range of movement of the pressing members in a direction perpendicular to a direction of pressing of the workpiece.

In an embodiment, the second piezoelectric elements are electronically coupled to a voltage distributor which is configured to distribute the voltage applied from the drive-voltage application device to the second piezoelectric elements.

In an embodiment, there is provided a polishing apparatus for polishing a workpiece, comprising: a polishing table for holding a polishing pad; a polishing-liquid supply nozzle configured to supply a polishing liquid onto the polishing pad; the polishing head system; and an operation controller configured to control operations of the polishing table, the polishing-liquid supply nozzle, and the polishing head system.

In an embodiment, the polishing apparatus further comprises a film-thickness sensor configured to measure a thickness of a film, to be processed, of the workpiece, the film-thickness sensor being arranged in the polishing table.

In an embodiment, the operation controller is configured to produce a film-thickness profile of the workpiece from measured values of the film thickness acquired by the film-thickness sensor, and to determine voltage instruction values for the drive-voltage application device based on the film-thickness profile.

In an embodiment, the operation controller is configured to determine voltage instruction values for the drive-voltage application device based on a difference between the film-thickness profile and a target film-thickness profile.

In an embodiment, the polishing apparatus further comprises a loading and unloading device configured to allow the polishing head to hold the workpiece thereon.

In an embodiment, the polishing apparatus further comprises an orientation detector configured to detect an orientation of the workpiece in its circumferential direction.

In an embodiment, there is provided a processing system for processing a workpiece, comprising: the polishing apparatus for polishing the workpiece; a cleaning device configured to clean the polished workpiece; a drying device configured to dry the cleaned workpiece; and a transporting device configured to transport the workpiece between the polishing apparatus, the cleaning device, and the drying device.

According to the above-described embodiments, the plurality of piezoelectric elements can precisely control the pressing force of the retainer member against the polishing pad in the circumferential direction of the retainer member. Therefore, the polishing head system can precisely control the circumferential distribution of the polishing rate of the edge portion of the workpiece.

DESCRIPTION OF EMBODIMENTS

Figure 1:
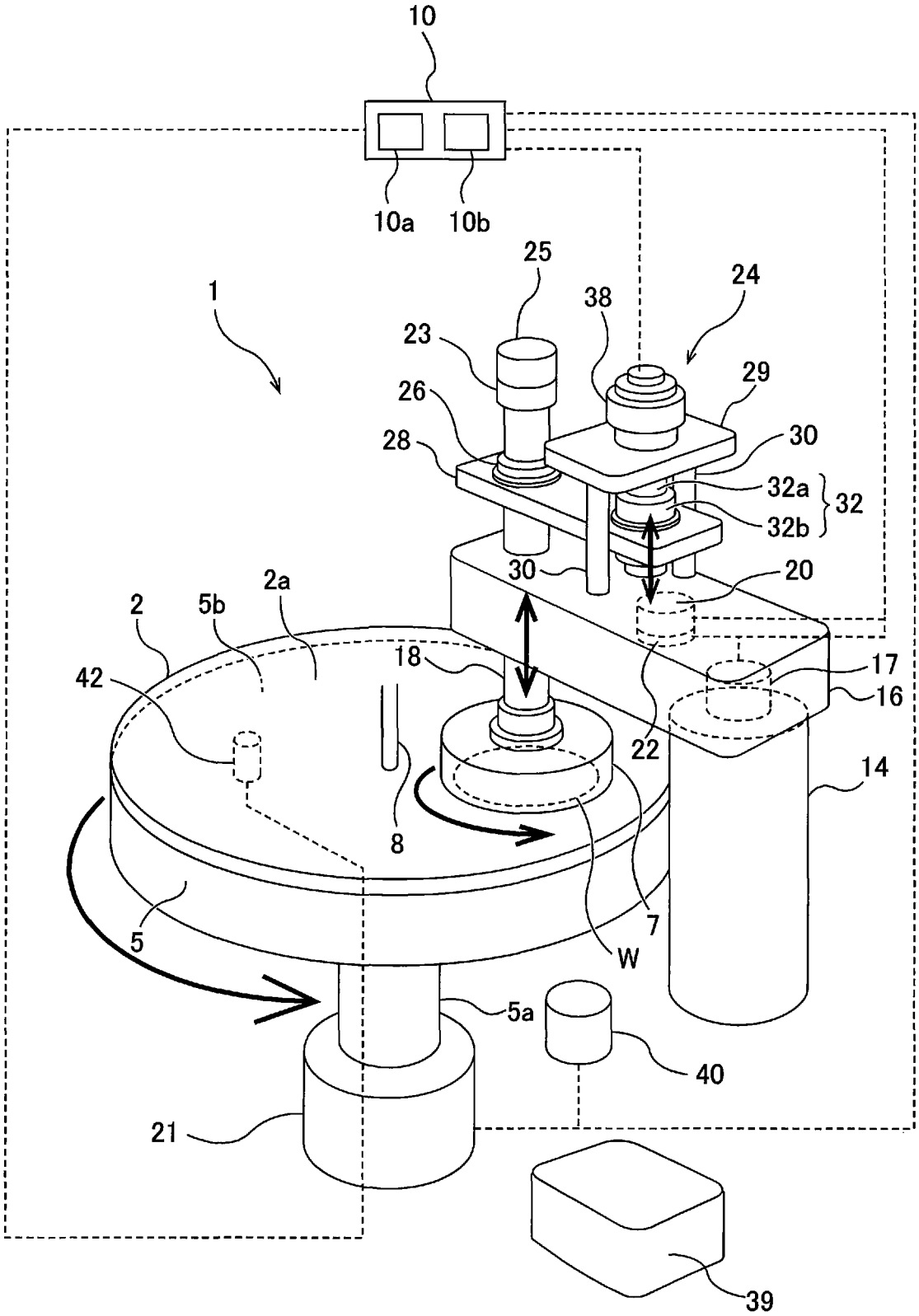
FIG. 1 is a schematic view showing an embodiment of a polishing apparatus.

Hereinafter, embodiments will be described with reference to the drawings. FIG. 1 is a schematic view showing an embodiment of a polishing apparatus. The polishing apparatus 1 is an apparatus configured to chemically and mechanically polish a workpiece, such as a wafer, a substrate, or a panel. As shown in FIG. 1, this polishing apparatus 1 includes a polishing table 5 that supports a polishing pad 2 having a polishing surface 2*a*, a polishing head 7 configured to press a workpiece W against the polishing surface 2*a*, a polishing-liquid supply nozzle 8 configured to supply a polishing liquid (for example, slurry containing abrasive grains) to the polishing surface 2*a*, and an operation controller 10 configured to control operations of the polishing apparatus. The polishing head 7 is configured to be able to hold the workpiece W on its lower surface. The workpiece W has a film to be polished.

The operation controller 10 includes a memory 10*a* storing programs therein, and an arithmetic device 10*b* configured to perform arithmetic operations according to instructions contained in the programs. The memory 10*a* includes a main memory, such as a RAM, and an auxiliary memory, such as a hard disk drive (HDD) or a solid state drive (SSD). Examples of the arithmetic device 10*b* include a CPU (central processing unit) and a GPU (graphic processing unit). However, the specific configuration of the operation controller 10 is not limited to these examples.

The operation controller 10 is composed of at least one computer. The at least one computer may be one server or a plurality of servers. The operation controller 10 may be an edge server, a cloud server connected to a communication network, such as the Internet or a local area network, or a fog computing device (gateway, Fog server, router, etc.) installed in the network. The operation controller 10 may be a plurality of servers connected by a communication network, such as the Internet or a local area network. For example, the operation controller 10 may be a combination of an edge server and a cloud server.

The polishing apparatus 1 further includes a support shaft 14, a polishing-head oscillation arm 16 coupled to an upper end of the support shaft 14, a polishing-head shaft 18 rotatably supported by a free end of the polishing-head oscillation arm 16, and a rotating motor 20 configured to rotate the polishing head 7 about its central axis. The rotating motor 20 is fixed to the polishing-head oscillation arm 16 and is coupled to the polishing-head shaft 18 via a torque transmission mechanism (not shown) constituted by a belt, pulleys or the like. The polishing head 7 is fixed to a lower end of the polishing-head shaft 18. The rotating motor 20 rotates the polishing-head shaft 18 via the above torque transmission mechanism, so that the polishing head 7 rotates together with the polishing-head shaft 18. In this way, the polishing head 7 is rotated about the central axis thereof by the rotating motor 20 in a direction indicated by arrow. The central axis of the polishing head 7 coincides with the central axis of the polishing-head shaft 18.

The rotating motor 20 is coupled to a rotary encoder 22 as a rotation angle detector configured to detect a rotation angle of the polishing head 7. The rotary encoder 22 is configured to detect a rotation angle of the rotating motor 20. The rotation angle of the rotating motor 20 coincides with the rotation angle of the polishing head 7. Therefore, the rotation angle of the rotating motor 20 detected by the rotary encoder 22 corresponds to the rotation angle of the polishing head 7. The rotary encoder 22 is coupled to the operation controller 10, and a detection value of the rotation angle of the rotating motor 20 output from the rotary encoder 22 (i.e., a detection value of the rotation angle of the polishing head 7) is sent to the operation controller 10.

The polishing apparatus 1 further includes a rotating motor 21 configured to rotate the polishing pad 2 and the polishing table 5 about their central axes. The rotating motor 21 is arranged below the polishing table 5, and the polishing table 5 is coupled to the rotating motor 21 via a rotation shaft 5*a*. The polishing table 5 and the polishing pad 2 are rotated about the rotation shaft 5*a* by the rotating motor 21 in a direction indicated by arrow. The central axes of the polishing pad 2 and the polishing table 5 coincide with the central axis of the rotation shaft 5*a*. The polishing pad 2 is attached to a pad support surface 5*b* of the polishing table 5. An exposed surface of the polishing pad 2 constitutes a polishing surface 2*a* for polishing the workpiece W, such as a wafer.

The polishing-head shaft 18 can move up and down relative to the polishing-head oscillation arm 16 by an elevating mechanism 24, so that the polishing head 7 is able to move up and down relative to the polishing-head oscillation arm 16 and the polishing table 5 by the vertical movement of the polishing-head shaft 18. A rotary connector 23 and a rotary joint 25 are attached to an upper end of the polishing-head shaft 18.

The elevating mechanism 24 for elevating and lowering the polishing-head shaft 18 and the polishing head 7 includes a bearing 26 that rotatably supports the polishing-head shaft 18, a bridge 28 to which the bearing 26 is fixed, a ball-screw mechanism 32 attached to the bridge 28, a support base 29 supported by support columns 30, and a servomotor 38 fixed to the support base 29. The support base 29 that supports the servomotor 38 is coupled to the polishing-head oscillation arm 16 via the support columns 30.

The ball-screw mechanism 32 includes a screw shaft 32*a* coupled to the servomotor 38 and a nut 32*b* into which the screw shaft 32*a* is screwed. The nut 32*b* is fixed to the bridge 28. The polishing-head shaft 18 is configured to move up and down (i.e., move in the vertical directions) together with the bridge 28. Therefore, when the servomotor 38 drives the ball-screw mechanism 32, the bridge 28 moves up and down to cause the polishing-head shaft 18 and the polishing head 7 to move up and down.

The elevating mechanism 24 functions as a polishing-head positioning mechanism for adjusting a height of the polishing head 7 relative to the polishing table 5. When polishing of the workpiece W is to be performed, the elevating mechanism 24 positions the polishing head 7 at a predetermined height. With the polishing head 7 maintained at the predetermined height, the polishing head 7 presses the workpiece W against the polishing surface 2*a* of the polishing pad 2.

The polishing apparatus 1 includes an arm-pivoting motor 17 configured to cause the polishing-head oscillation arm 16 to pivot around the support shaft 14. When the arm-pivoting motor 17 causes the polishing-head oscillation arm 16 to pivot, the polishing head 7 moves in a direction perpendicular to the polishing-head shaft 18. The arm-pivoting motor 17 can move the polishing head 7 between a polishing position above the polishing table 5 and a loading and unloading position outside the polishing table 5.

The workpiece W to be polished is attached to the polishing head 7 by a loading and unloading device 39 at the loading and unloading position, and then moved to the polishing position. The polished workpiece W is moved from the polishing position to the loading and unloading position, and is removed from the polishing head 7 by the loading and unloading device 39 at the loading and unloading position. In FIG. 1, the loading and unloading device 39 is schematically depicted. The position and configuration of the loading and unloading device 39 are not particularly limited as long as its intended purpose can be achieved.

The polishing apparatus 1 includes a notch aligner 40 as an orientation detector configured to detect an orientation of the workpiece W in the circumferential direction of the workpiece W. Although the notch aligner 40 is independently arranged in the polishing apparatus 1 in this figure, the notch aligner 40 may be integrally arranged with the loading and unloading device 39. The notch aligner 40 is a device for detecting a notch (or a cut) formed in an edge of the workpiece W. The specific configuration of the notch aligner 40 is not particularly limited as long as it can detect the notch. In one example, the notch aligner 40 is an optical notch detector configured to apply a laser beam to the edge of the workpiece W while rotating the workpiece W. and to detect the reflected laser beam by a light receiving unit. This type of notch detector can detect the position of the notch because the intensity of the received laser light changes at the notch position. Another example is a liquid notch detector configured to emit a jet of a liquid, such as pure water, from a nozzle arranged close to the edge of the workpiece W to the edge of the workpiece W while rotating the workpiece W, and detect pressure or flow rate of the liquid flowing toward the nozzle. This type of notch detector can detect the position of the notch because the pressure or flow rate of the liquid changes at the notch position.

The detection of the notch, i.e., the detection of the orientation of the workpiece W in the circumferential direction is performed before polishing of the workpiece W. The purpose of detecting the notch is to recognize and correct the arrangement of the workpiece W with respect to arrangements of piezoelectric elements which will be described later. The detection of the notch may be performed before the workpiece W is held by the polishing head 7, or may be performed with the workpiece W held by the polishing head 7. For example, in the case where the detection of the notch is performed before the workpiece W is held by the polishing head 7, the notch position of the workpiece W is detected by the notch aligner 40 at the loading and unloading position. Then, the polishing head 7 is rotated until the detected notch position reaches a specific position of the polishing head 7. Thereafter, the workpiece W is transferred to the polishing head 7 by the loading and unloading device, so that the workpiece W is held on the polishing head 7 by vacuum suction or other technique.

The notch aligner 40 is coupled to the operation controller 10. The operation controller 10 is configured to associate the position of the notch of the workpiece W with the rotation angle of the polishing head 7. More specifically, the operation controller 10 designates a reference position of the rotation angle of the polishing head 7 based on the position of the notch detected by the notch aligner 40, and stores the reference position of the rotation angle in the memory 10*a*. The notch position detected by the notch aligner 40 is also stored in the memory 10*a* at the same time. The operation controller 10 compares the reference position with the notch position, so that the operation controller 10 can determine a position on the surface of the workpiece W based on the reference position of the rotation angle of the polishing head 7.

Then, for example, the polishing head 7 is rotated by a certain angle by the rotating motor 20 such that the notch position of the workpiece W is corrected so as to be at a predetermined angle with respect to the reference position of the polishing head 7. Thereafter, the workpiece W is transferred to the loading and unloading device and held by the polishing head 7. Once the reference position of the rotation angle of the polishing head 7 is set based on the arrangement of the piezoelectric elements described later, the polishing head 7 can hold the workpiece W in a state such that the workpiece W corresponds to the specific arrangement of the piezoelectric elements.

Polishing of the workpiece W is performed as follows. The workpiece W, with its surface to be polished facing downward, is held by the polishing head 7. While the polishing head 7 and the polishing table 5 are rotating independently, the polishing liquid (for example, slurry containing abrasive grains) is supplied onto the polishing surface 2*a* of the polishing pad 2 from the polishing-liquid supply nozzle 8 provided above the polishing table 5. The polishing pad 2 rotates about its central axis together with the polishing table 5. The polishing head 7 is moved to the predetermined height by the elevating mechanism 24. Further, while the polishing head 7 is maintained at the above predetermined height, the polishing head 7 presses the workpiece W against the polishing surface 2*a* of the polishing pad 2. The workpiece W rotates together with the polishing head 7. Specifically, the workpiece W rotates at the same speed as the polishing head 7. The workpiece W is rubbed against the polishing surface 2*a* of the polishing pad 2 in the presence of the polishing liquid on the polishing surface 2*a* of the polishing pad 2. The surface of the workpiece W is polished by a combination of the chemical action of the polishing liquid and the mechanical action of the abrasive grains contained in the polishing liquid or the polishing pad 2.

The polishing apparatus 1 includes a film-thickness sensor 42 configured to measure a film thickness of the workpiece W on the polishing surface 2*a*. The film-thickness sensor 42 is configured to generate a film-thickness index value that directly or indirectly indicates the film thickness of the workpiece W. This film-thickness index value changes according to the film thickness of the workpiece W. The film-thickness index value may be a value representing the film thickness of the workpiece W itself, or may be a physical quantity or a signal value before being converted into the film thickness.

Examples of the film-thickness sensor 42 include an eddy current sensor and an optical film-thickness sensor. The film-thickness sensor 42 is arranged in the polishing table 5 and rotates together with the polishing table 5. More specifically, the film-thickness sensor 42 is configured to measure the film thickness at a plurality of measurement points of the workpiece W while moving across the workpiece W on the polishing surface 2*a* each time the polishing table 5 makes one rotation. The film-thickness index values representing the film thicknesses at the plurality of measurement points are output from the film-thickness sensor 42, and are sent to the operation controller 10. The operation controller 10 is configured to control the operation of the polishing head 7 based on the film-thickness index values.

The operation controller 10 produces a film-thickness profile of the workpiece W from the film-thickness index values output from the film-thickness sensor 42. The film-thickness profile of the workpiece W is a distribution of film-thickness index values. The operation controller 10 is configured to control the operations of the polishing head 7 so as to eliminate a difference between the current film-thickness profile of the workpiece W and a target film-thickness profile of the workpiece W. The target film-thickness profile of the workpiece W is stored in advance in the memory 10*a* of the operation controller 10. Examples of the current film-thickness profile of the workpiece W include an initial film-thickness profile of the workpiece W before being polished by the polishing apparatus 1 shown in FIG. 1 and a film-thickness profile produced from the film-thickness index values output from the film-thickness sensor 42 when the polishing apparatus 1 shown in FIG. 1 is polishing the workpiece W. The initial film-thickness profile may be produced from, for example, film thickness measurement values acquired by a stand-alone film thickness measuring device (not shown) or film thickness measurement values acquired by another polishing apparatus equipped with a film-thickness sensor. The initial film-thickness profile is stored in the memory 10*a* of the operation controller 10.

Figure 2:
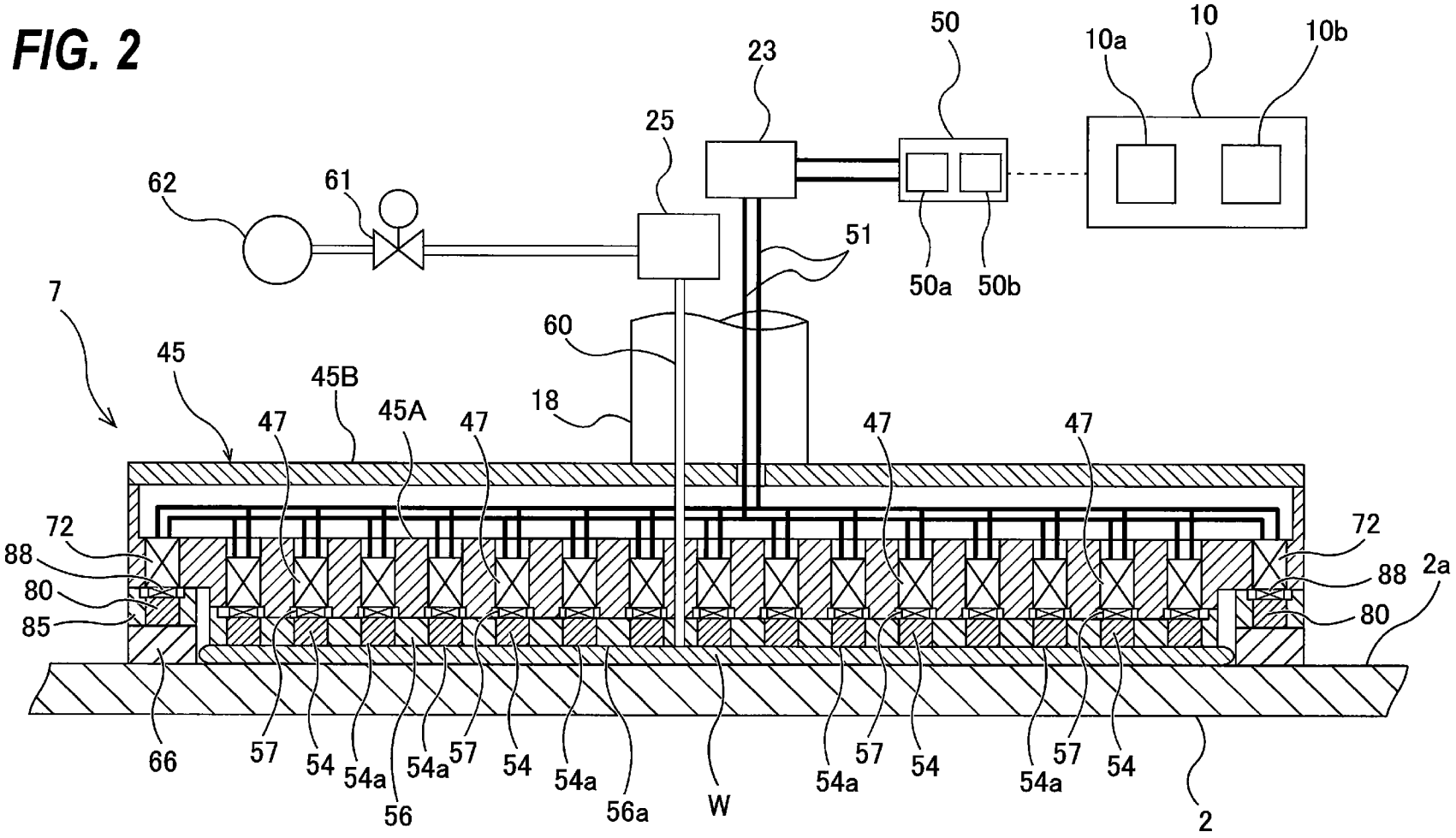
FIG. 2 is a cross-sectional view showing an embodiment of a polishing head system including a polishing head shown in FIG. 1.

FIG. 2 is a cross-sectional view showing an embodiment of a polishing head system including the polishing head 7 shown in FIG. 1. As shown in FIG. 2, the polishing head system includes the polishing head 7, the operation controller 10, and a drive-voltage application device 50. The polishing head 7 is configured to press the workpiece W against the polishing surface 2*a* of the polishing pad 2. The polishing head 7 includes a carrier 45 fixed to the lower end of the polishing-head shaft 18, and a plurality of piezoelectric elements 47 held by the carrier 45. The polishing head 7 is rigidly fixed to the lower end of the polishing-head shaft 18, so that the angle of the polishing head 7 with respect to the polishing-head shaft 18 is fixed. The plurality of piezoelectric elements 47 are located at the back side of the workpiece W.

The carrier 45 has a housing 45A that holds the plurality of piezoelectric elements 47, and a flange 45B that is detachably attached to the housing 45A. The flange 45B is fixed to the housing 45A by screw (not shown). Although not shown, a lid for maintenance may be provided on the flange 45B. When the lid is removed, a user can access the piezoelectric elements 47. The lid of the flange 45B is removed when maintenance, such as replacement of the piezoelectric element 47 or position adjustment of the piezoelectric element 47, is required.

The polishing head 7 includes a plurality of actuators capable of independently applying a plurality of pressing forces to the workpiece W. Such actuators may be hydraulic actuators (e.g., hydraulic cylinders or hydraulic motors), pneumatic actuators (e.g., pneumatic motors or pneumatic cylinders), electric actuators (e.g., electric motors), actuators using piezoelectric elements described later, magnetostrictive actuators using magnetostrictive elements, electromagnetic actuators (e.g., linear motors), small pistons, or the like.

In this embodiment, the plurality of piezoelectric elements 47 are adopted as the plurality of actuators capable of applying a plurality of pressing forces to the workpiece W independently. The piezoelectric elements 47 are electrically connected to the drive-voltage application device 50 through power lines 51. The piezoelectric elements 47 are driven by the drive-voltage application device 50 as a drive source.

The power lines 51 extend via the rotary connector 23. The drive-voltage application device 50 includes a power supply unit 50*a* and a voltage controller 50*b*. The voltage controller 50*b* is configured to send instruction values of voltage, to be applied to the piezoelectric elements 47, to the power supply unit 50*a*. The drive-voltage application device 50 is configured to apply voltages independently to the piezoelectric elements 47, respectively.

The drive-voltage application device 50 is coupled to the operation controller 10. The operation controller 10 is configured to determine the plurality of instruction values of voltages to be applied to the plurality of piezoelectric elements 47, and send the determined plurality of instruction values to the voltage controller 50*b* of the drive-voltage application device 50. The voltage controller 50*b* is configured to instruct the power supply unit 50*a* according to these instruction values, so that the power supply unit 50*a* applies a predetermined voltage to each piezoelectric element 47. The power supply unit 50*a* is composed of a DC power supply, an AC power supply, or a programmable power supply in which a voltage pattern can be set, or a combination thereof.

The polishing head 7 further includes a plurality of pressing members 54 coupled to the plurality of piezoelectric elements 47, respectively, a holding member 56 that holds the plurality of pressing members 54, and a plurality of pressing-force measuring devices 57 configured to measure a plurality of pressing forces generated by the plurality of piezoelectric elements 47, respectively. The plurality of pressing members 54 and the holding member 56 face the back side of the workpiece W.

When the drive-voltage application device 50 applies the voltages to the plurality of piezoelectric elements 47, respectively, these piezoelectric elements 47 expand toward the pressing members 54. The expansion of the piezoelectric elements 47 generates the pressing forces that press the workpiece W against the polishing surface 2*a* of the polishing pad 2 via the pressing members 54. In this way, the piezoelectric elements 47 to which the voltages are applied can independently apply the pressing forces to the workpiece W. and can therefore press a plurality of portions (or regions) of the workpiece W against the polishing surface 2*a* with different pressing forces.

In the present embodiment, the end surfaces of the plurality of pressing members 54 constitute pressing surfaces 54*a* for pressing the workpiece W against the polishing surface 2*a*. The pressing surfaces 54*a* of the pressing members 54 are in contact with the back side of the workpiece W. Each pressing surface 54*a* may be made of an elastic member, such as silicone rubber. Specific examples of the shape of the pressing surface 54*a* include a regular polygonal shape, a circular shape, a fan shape, an arc shape, an ellipse shape, and a combination of these shapes. Examples of regular polygonal shape having the same distance from the center of the pressing surface 54*a* to vertices include a regular triangular shape, a regular quadrangular shape, and a regular hexagonal shape.

The holding member 56 holds the plurality of pressing members 54 so as to allow these pressing members 54 to be movable within a limited range. More specifically, the holding member 56 permits the pressing members 54 to move m the vertical direction wile limiting the range of the movement of the pressing members 54 in the vertical and horizontal directions by a clearance. The holding member 56 limits the range of movement of the plurality of pressing members 54 in the direction perpendicular to the direction of pressing the workpiece W. Since the vertical movements of the pressing members 54 are restricted, the pressing members 54 can prevent an excessive impact or force from being transmitted to the piezoelectric elements 47. In one embodiment, the plurality of pressing members 54 and the holding member 56 may be omitted, and the plurality of piezoelectric elements 47 may directly press the back surface of the workpiece W so as to press the workpiece W against the polishing surface 2*a* of the polishing pad 2.

The polishing head system further includes a vacuum line 60 that enables the polishing head 7 to hold the workpiece W thereon by vacuum suction. The vacuum line 60 extends via the rotary joint 25 and communicates with a workpiece contact surface 56*a* of the polishing head 7. More specifically, one end of the vacuum line 60 is open in the workpiece contact surface 56*a* of the polishing head 7, and the other end of the vacuum line 60 is coupled to a vacuum source 62, such as a vacuum pump. A vacuum valve 61 is attached to the vacuum line 60. The vacuum valve 61 is an actuator-driven on-off valve (for example, an electric-motor-operated valve, a solenoid valve, an air-operated valve), and is coupled to the operation controller 10. The operation of the vacuum valve 61 is controlled by the operation controller 10. When the operation controller 10 opens the vacuum valve 61, the vacuum line 60 forms a vacuum on the workpiece contact surface 56*a* of the polishing head 7, whereby the polishing head 7 can hold the workpiece W on the workpiece contact surface 56*a* of the polishing head 7 by the vacuum suction.

In one embodiment, in order to prevent the workpiece W from rotating relative to the polishing head 7 during polishing of the workpiece W (i.e., in order to fix the position of the workpiece W relative to the polishing head 7), the vacuum line 60 may form the vacuum on the workpiece contact surface 56*a* of the polishing head 7 to hold the workpiece W on the workpiece contact surface 56*a* of the polishing head 7 by the vacuum suction. In this figure, one vacuum line 60 is arranged at the center of the workpiece W, but a plurality of vacuum lines 60 that are open at a plurality of locations in the workpiece contact surface 56*a* may be provided.

The polishing head 7 further includes a retainer member 66 arranged outside the plurality of piezoelectric elements 47, and a plurality of piezoelectric elements 72 coupled to the retainer member 66. Each piezoelectric element 72 is an actuator for pressing the retainer member 66 against the polishing surface 2*a* of the polishing pad 2. The retainer member 66 is arranged so as to surround the workpiece W, the plurality of pressing members 54, and the plurality of piezoelectric elements 47. In the present embodiment, the workpiece W has a circular shape, and the entire retainer member 66 has an annular shape surrounding the workpiece W. The retainer member 66 may be made of a resin material, such as PPS or PEEK. The retainer member 66 may have grooves in its contact surface with the polishing surface 2*a* for regulating inflow of the polishing liquid.

The piezoelectric elements 72 are held by the housing 45A of the carrier 45 as well as the piezoelectric elements 47. The polishing head 7 further includes a plurality of coupling members 80 coupled to the piezoelectric elements 72, respectively, a holding member 85 holding the plurality of coupling members 80, and a plurality of pressing-force measuring devices 88 configured to measure pressing forces generated by the plurality of piezoelectric elements 72, respectively. The holding member 85 has an annular shape and is fixed to the carrier 45. The plurality of piezoelectric elements 72 are coupled to the retainer member 66 via the plurality of coupling members 80 and the plurality of pressing-force measuring devices 88.

The plurality of piezoelectric elements 72 are electrically coupled to the drive-voltage application device 50. The operation controller 10 is configured to determine instruction values of voltages to be applied to the piezoelectric elements 72, and send the determined instruction values to the voltage controller 50*b* of the drive-voltage application device 50. The voltage controller 50*b* is configured to instruct the power supply unit 50*a* according to these instruction values to apply predetermined voltages to the respective piezoelectric elements 72.

When the voltages are applied to the piezoelectric elements 72, the piezoelectric elements 72 push the pressing-force measuring devices 88 and the coupling members 80 toward the polishing surface 2*a* of the polishing pad 2, and the coupling members 80 in turn press the retainer member 66 against the polishing surface 2*a* of the polishing pad 2 with pressing forces corresponding to the voltages applied to the piezoelectric elements 72. Measured values of the pressing forces are sent from the pressing-force measuring devices 88 to the operation controller 10. The operation controller 10 adjusts the instruction values of the voltages to be applied to the piezoelectric elements 72 based on the measured values of the pressing forces.

Figure 3:
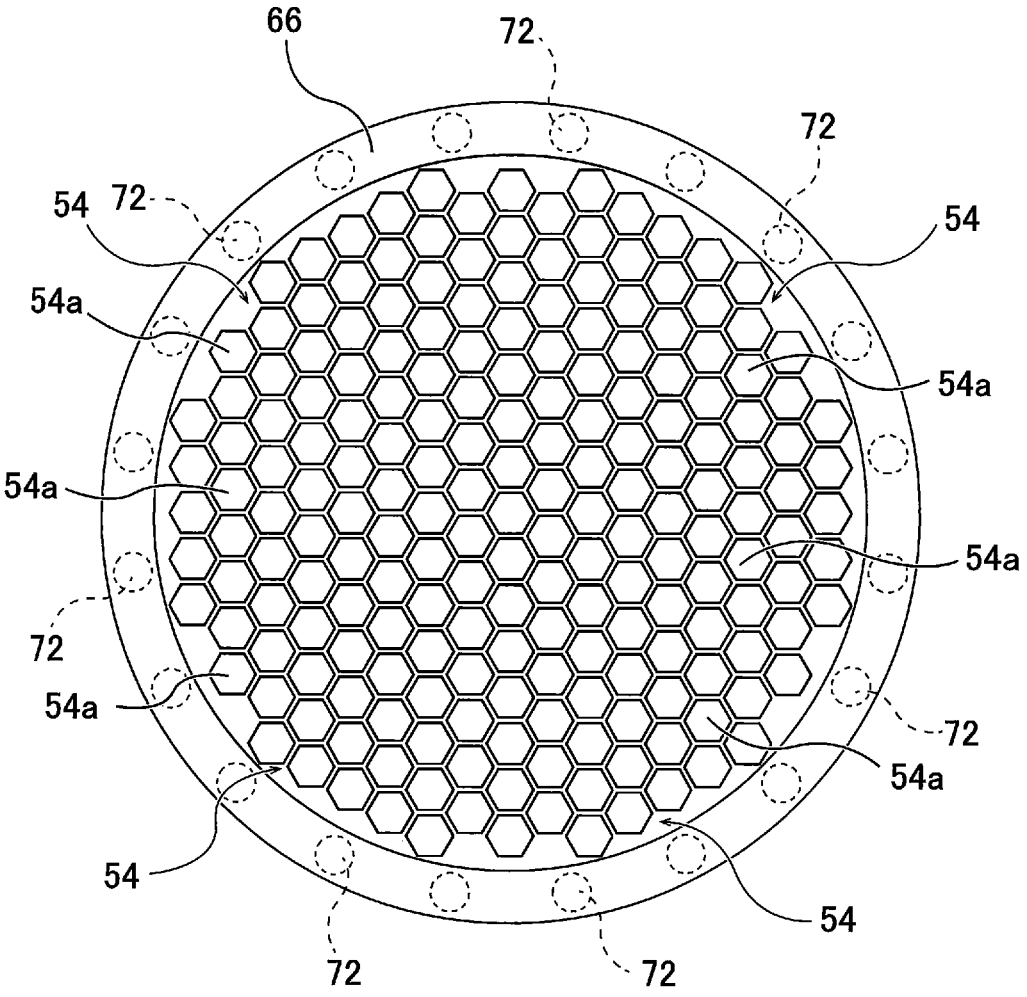
FIG. 3 is a schematic view of pressing members, piezoelectric elements, and a retainer member as viewed from below.

FIG. 3 is a schematic view of the pressing members 54, the piezoelectric elements 72, and the retainer member 66 as viewed from below. As shown in FIG. 3, the piezoelectric elements 72 are arranged so as to surround the pressing members 54 (and the piezoelectric elements 47). The retainer member 66 is arranged along the periphery of the workpiece W (not shown in FIG. 3). The piezoelectric elements 72 are arranged along the retainer member 66.

In the example shown in FIG. 3, the plurality of pressing members 54 are arranged in a honeycomb pattern, and the pressing surface 54*a* of each pressing member 54 is in a shape of a regular hexagon. As can be seen from FIG. 3, the regular hexagonal pressing surfaces 54*a* forming the honeycomb array can minimize a gap between the adjacent pressing surfaces 54*a*. Further, the regular hexagon has an advantage that an angle of each vertex is larger than those of the equilateral triangle and the square, and stress concentration is less likely to occur.

Each pressing member 54 shown in FIG. 3 is coupled to each piezoelectric element 47. Therefore, the arrangement of the pressing members 54 shown in FIG. 3 is substantially the same as the arrangement of the piezoelectric elements 47. The plurality of piezoelectric elements 47 and the plurality of pressing members 54 are distributed along the radial direction and the circumferential direction of the polishing head 7. Therefore, the polishing head system can precisely control the film-thickness profile of the workpiece W. In particular, the polishing head system can eliminate the variation in film thickness in the circumferential direction of the workpiece W.

The arrangement of the pressing members 54 is not limited to the example shown in FIG. 3, and may be other arrangement, such as a grid arrangement, a concentric arrangement, or a staggered arrangement. Further, the pressing surface 54*a* of each pressing member 54 is not limited to the regular hexagon, and may be a circular shape, a rectangular shape, a fan shape, or a combination thereof.

Figure 4:
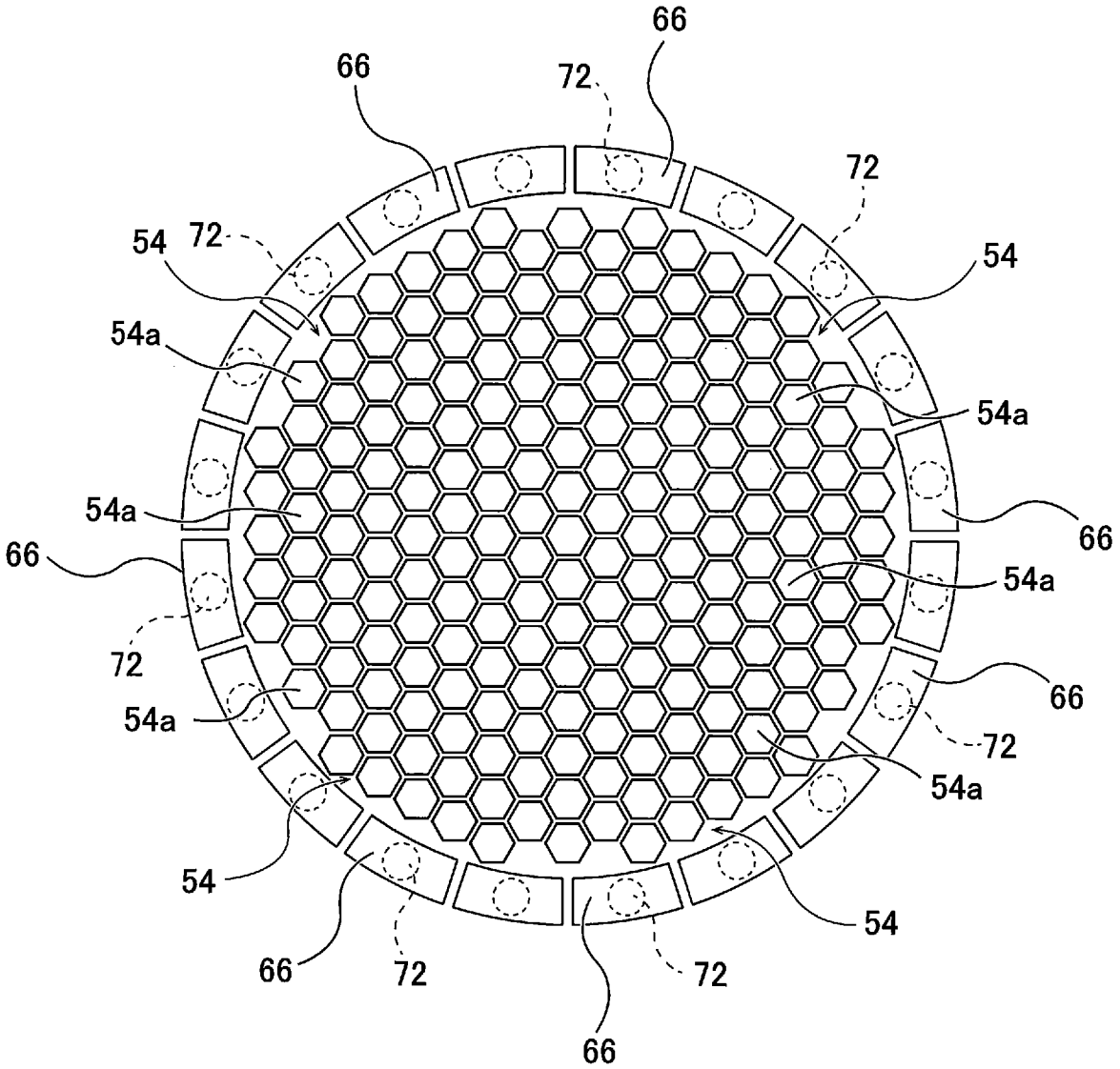
FIG. 4 is a schematic view of pressing members, piezoelectric elements, and retainer members as viewed from below.

As shown in FIG. 4, in one embodiment, the polishing head 7 may include a plurality of retainer members 66. The plurality of retainer members 66 are arranged so as to surround the workpiece W, the plurality of pressing members 54, and the plurality of piezoelectric elements 47. The plurality of piezoelectric elements 72 are coupled to the plurality of retainer members 66, respectively, via the plurality of coupling members 80 (see FIG. 5) and the plurality of pressing-force measuring devices 88 (see FIG. 5).

Figure 5:
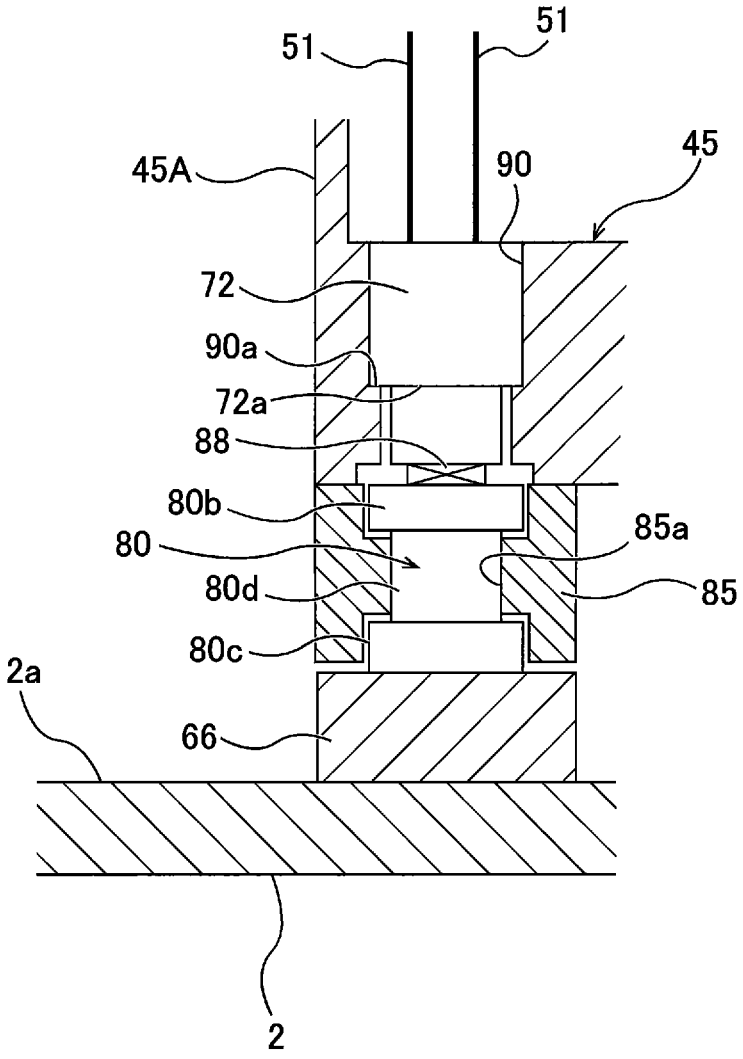
FIG. 5 is a cross-sectional view showing the piezoelectric element, a holding member, a coupling member, and the retainer member shown in FIG. 2.

FIG. 5 is a cross-sectional view showing the piezoelectric element 72, the holding member 85, the coupling member 80, and the retainer member 66 shown in FIG. 2. The following descriptions with reference to FIG. 5 are also applied to the embodiment of FIG. 4. As shown in FIG. 5, the housing 45A of the carrier 45 has a plurality of stepped holes 90. The plurality of piezoelectric elements 72 are located in these stepped holes 90, respectively. Each piezoelectric element 72 has a stopper protrusion 72*a*. When the stopper protrusion 72*a* contacts a stepped portion 90*a* of the stepped hole 90, the relative positioning of the piezoelectric element 72 with respect to the carrier 45 is achieved.

In the present embodiment, each pressing-force measuring device 88 is arranged in series with the piezoelectric element 72 and the coupling member 80. More specifically, each pressing-force measuring device 88 is arranged between the piezoelectric element 72 and the coupling member 80. The pressing-force measuring devices 88 arranged in this way can separately measure the pressing forces generated respectively by the piezoelectric elements 72. The arrangement of the pressing-force measuring devices 88 is not limited to the embodiment shown in FIG. 5. The pressing-force measuring devices 88 may be arranged between the retainer ring 66 and the coupling members 80, or may be arranged next to the coupling members 80, as long as the pressing-force measuring devices 88 can separately measure the pressing forces generated by the piezoelectric elements 72, respectively.

Each pressing-force measuring device 88 may be configured to convert the measured pressing force [N] into pressure [Pa]. Examples of the pressing-force measuring device 88 include load cell and piezoelectric sheet coupled to the plurality of piezoelectric elements 72. The piezoelectric sheet has a plurality of piezoelectric sensors, and each piezoelectric sensor is configured to generate a voltage corresponding to the force applied to the piezoelectric sheet and convert a value of the voltage into a force or a pressure.

End surfaces of the plurality of coupling members 80 are coupled to the retainer member 66. The holding member 85 holds the plurality of coupling members 80 so as to allow these coupling members 80 to be movable within a limited range. More specifically, each coupling member 80 has protrusions 80*b* and 80*c* located at upper and lower ends thereof, and further has a body portion 80*d* located between the protrusions 80*b* and 80*c*. The width of the body portion 80*d* is smaller than the widths of the protrusions 80*b* and 80*c*. The holding member 85 has a supporting portion 85*a* that movably supports the coupling member 80 with a certain clearance between the supporting portion 85*a* and the body portion 80*d*. The protrusions 80*b* and 80*c* of each coupling member 80 and the supporting portion 85*a* of the holding member 85 permit each coupling member 80 to move in the vertical direction while limiting the range of the movement of the coupling member 80 in the vertical and horizontal directions by the clearance. The supporting portion 85*a* of the holding member 85 limits the range of movement of the coupling member 80 in the direction perpendicular to a direction of pressing the retainer member 66. Since the vertical movement of the coupling member 80 is restricted, the coupling member 80 can prevent an excessive impact or force from being transmitted to the piezoelectric element 72.

When the polishing pad 2 is pressed by the retainer member 66, the polishing pad 2 is deformed, and a part of the polishing pad 2 rises upward around the retainer member 66. As a result, the contact pressure of the polishing pad 2 increases at the edge portion of the workpiece W, so that the polishing rate of the edge portion of the workpiece W can be increased. According to the present embodiment, since the plurality of piezoelectric elements 72 can independently press the retainer member 66 against the polishing surface 2*a* of the polishing pad 2, the distribution of the polishing rates of the edge portion of the workpiece W can be precisely controlled.

Next, an example of the operation of the polishing head 7 will be described. The operation controller 10 calculates a difference between a current film-thickness profile of the workpiece W and a target film-thickness profile stored in advance in the memory 10*a*, and creates a distribution of target polishing amounts for the surface, to be polished, of the workpiece W. Further, the operation controller 10 determines instruction values of the voltage to be applied to the piezoelectric elements 72 and the piezoelectric elements 47 in order to achieve the target polishing amounts within a predetermined polishing time, based on the determined distribution of the target polishing amounts. For example, the operation controller 10 creates a distribution of target polishing rates from the distribution of the target polishing amounts and the above predetermined polishing time, and determines the instruction values of the voltage capable of achieving the target polishing rates from a polishing rate correlation data. The polishing rate correlation data is data showing a relationship between the polishing rate and the instruction value of the voltage.

The operation controller 10 sends the instruction values to the voltage controller 50*b* of the drive-voltage application device 50. The voltage controller 50*b* instructs the power supply unit 50*a* according to the instruction values of the voltage to apply predetermined voltages to the piezoelectric elements 72 and the piezoelectric elements 47 so as to adjust the film-thickness profile of the workpiece W. During polishing of the workpiece W, the film-thickness profile is adjusted, for example, at regular time intervals or at every rotation cycle of the polishing table 5.

In another example of the operation of the polishing head 7, the operation controller 10 may determine, without producing the distribution of the target polishing amounts, the instruction values of the voltage to be applied to the piezoelectric elements 72 and the piezoelectric elements 47 based on the current film-thickness profile of the workpiece W obtained by the film-thickness sensor 42. For example, w % ben the target film-thickness profile is a flat film-thickness profile, the operation controller 10 determines instruction values for applying voltages higher than currently-applied voltages by predetermined amounts of change to the piezoelectric element 72 and the piezoelectric element 47 corresponding to a region where the film-thickness index value is large in order to make the current film-thickness profile closer to the flat film-thickness profile. Conversely, the operation controller 10 determines instruction values for applying voltages lower than currently-applied voltages by predetermined amounts of change to other piezoelectric element 72 and piezoelectric element 47 corresponding to a region where the film-thickness index value is small. The amount of change in the voltage is set as a parameter in advance in the operation controller 10.

Referring back to FIG. 2, in the present embodiment, each pressing-force measuring device 57 is arranged in series with the piezoelectric element 47 and the pressing member 54. More specifically, each pressing-force measuring device 57 is arranged between the piezoelectric element 47 and the pressing member 54. The pressing-force measuring devices 57 arranged in this way can separately measure the pressing forces generated respectively by the piezoelectric elements 47. The arrangement of the pressing-force measuring devices 57 is not limited to the embodiment shown in FIG. 2. The pressing-force measuring devices 57 may be arranged between the workpiece W and the pressing members 54, or may be arranged next to the pressing members 54, as long as the pressing-force measuring devices 57 can separately measure the pressing forces generated by the piezoelectric elements 47, respectively.

Each pressing-force measuring device 57 may be configured to convert the measured pressing force [N] into pressure [Pa]. Examples of the pressing-force measuring device 57 include a load cell and a piezoelectric sheet coupled to the plurality of piezoelectric elements 47. The piezoelectric sheet has a plurality of piezoelectric sensors, and each piezoelectric sensor is configured to generate a voltage corresponding to the force applied to the piezoelectric sheet and convert a value of the voltage into a force or a pressure.

When a voltage is applied to the piezoelectric element 47, the piezoelectric element 47 pushes the pressing-force measuring device 57 and the pressing member 54 toward the polishing surface 2*a* of the polishing pad 2, and the pressing member 54 in turn presses a corresponding portion (region) of the workpiece W against the polishing surface 2*a* with a pressing force corresponding to the voltage applied to the piezoelectric element 47. A measured value of the pressing force is sent from the pressing-force measuring devices 57 to the operation controller 10. The operation controller 10 adjusts the instruction value of the voltage to be applied to the piezoelectric element 47 based on the measured value of the pressing force.

Figure 6:
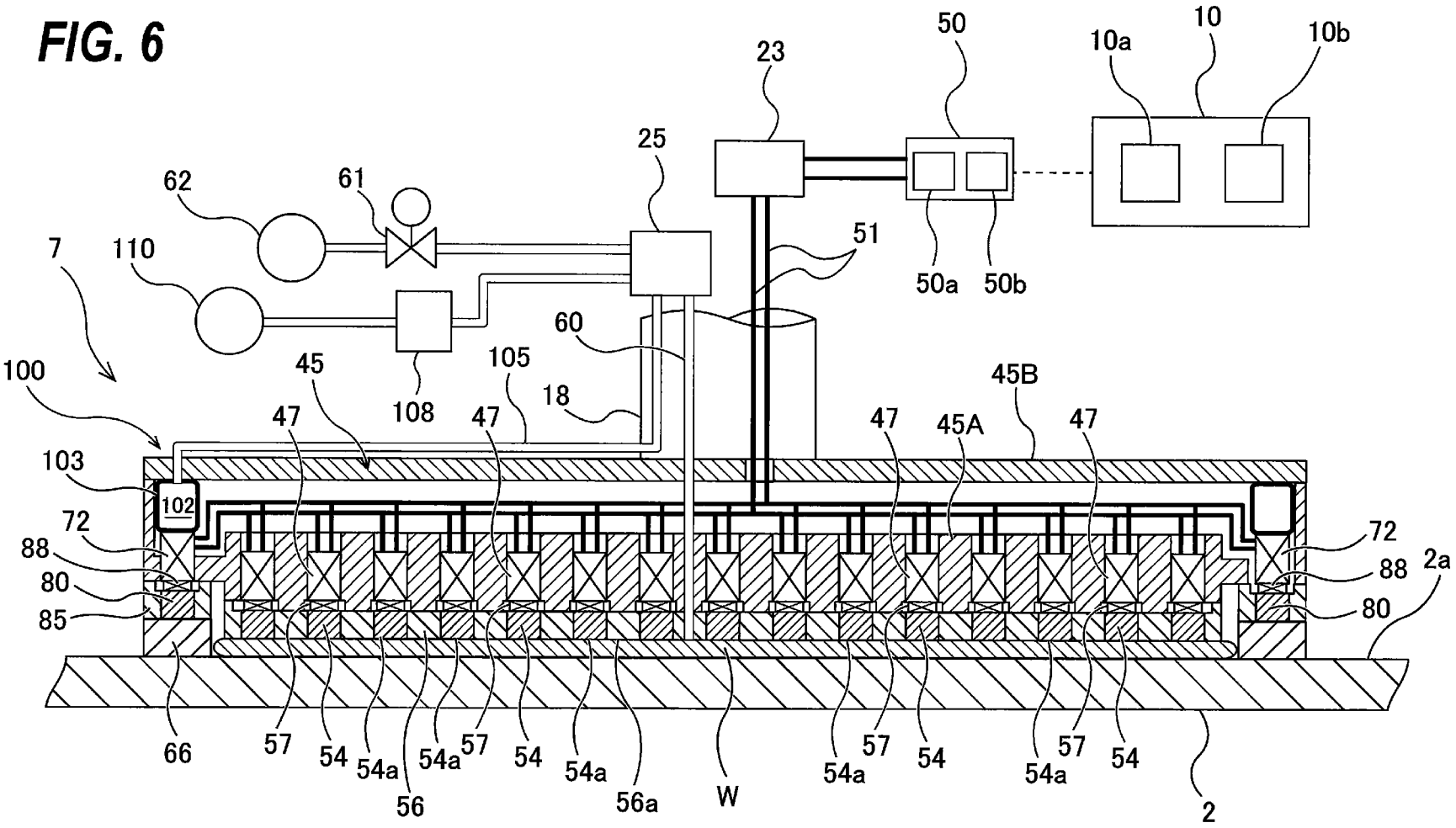
FIG. 6 is a cross-sectional view showing another embodiment of the polishing head system.

FIG. 6 is a cross-sectional view showing another embodiment of the polishing head system. Configurations and operations of this embodiment, which will not be particularly described, are the same as those of the embodiments described with reference to FIGS. 1 to 5, and repetitive descriptions will be omitted.

The polishing head system includes a retainer-member moving device 100 configured to move the entirety of the plurality of piezoelectric elements 72 and the retainer member 66 toward the polishing surface 2*a* of the polishing pad 2 relative to the piezoelectric elements 47. The retainer-member moving device 100 includes an elastic bag 103 that forms a pressure chamber 102 therein, a gas supply line 105 that communicates with the pressure chamber 102, and a pressure regulator 108 coupled to the gas supply line 105. The plurality of piezoelectric elements 72 are supported by the housing 45A of the carrier 45 so as to be vertically movable.

The elastic bag 103 is located in the carrier 45 of the polishing head 7, and a part of the elastic bag 103 is held by the carrier 45. The elastic bag 103 is made of a flexible elastic material that is expandable and contractible. The elastic bag 103 extends along the entire retainer member 66. In this embodiment, the retainer member 66 has an annular shape and the elastic bag 103 also has an annular shape.

The gas supply line 105 extends to a compressed-gas supply source 110 via the rotary joint 25. The compressed-gas supply source 110 may be a utility facility installed in a factory w % here the polishing apparatus 1 is installed, or may be a pump configured to deliver a compressed gas. Compressed gas, such as compressed air, is supplied from the compressed-gas supply source 110 through the gas supply line 105 into the pressure chamber 102.

The pressure regulator 108 is attached to the gas supply line 105 and is configured to regulate the pressure of the compressed gas in the pressure chamber 102. The pressure regulator 108 is coupled to the operation controller 10, and the operation of the pressure regulator 108 (i.e., the pressure of the compressed gas in the pressure chamber 102) is controlled by the operation controller 10. More specifically, the operation controller 10 sends a pressure instruction value to the pressure regulator 108, and the pressure regulator 108 operates such that the pressure in the pressure chamber 102 is maintained at the pressure instruction value.

When the compressed gas is supplied into the pressure chamber 102, the elastic bag 103 inflates to move the entirety of the piezoelectric elements 72 and retainer member 66 toward the polishing surface 2*a* of the polishing pad 2, while the position of the carrier 45 and the positions of the piezoelectric elements 47 (which serve as actuators) do not change. Therefore, the retainer-member moving device 100 can apply a uniform pressing force to the entirety of the piezoelectric elements 72 and the retainer member 66 independently of the pressing force applied to the workpiece W from the piezoelectric elements 47.

According to the present embodiment, the retainer-member moving device 100 can move the entirety of the piezoelectric elements 72 and the retainer member 66 toward the polishing surface 2*a* of the polishing pad 2 to press the retainer member 66 against the polishing surface 2*a* with a uniform force. Furthermore, the plurality of piezoelectric elements 72 can press the retainer member 66 against the polished surface 2*a* with locally different pressures. The operation controller 10 may instruct both the retainer-member moving device 100 and the piezoelectric elements 72 to operate at the same time, or may instruct one of them to operate selectively.

In FIG. 6, the elastic bag 103 is arranged so as to directly push the piezoelectric elements 72, while the piezoelectric elements 72 may be arranged in a casing (not shown), and the elastic bag 103 may push the casing to move the entirety of the piezoelectric elements 72 and the retainer member 66 toward the polishing surface 2*a* of the polishing pad 2. The casing can prevent an excessive force of the elastic bag 103 from being directly transmitted to the piezoelectric elements 72.

Figure 7:
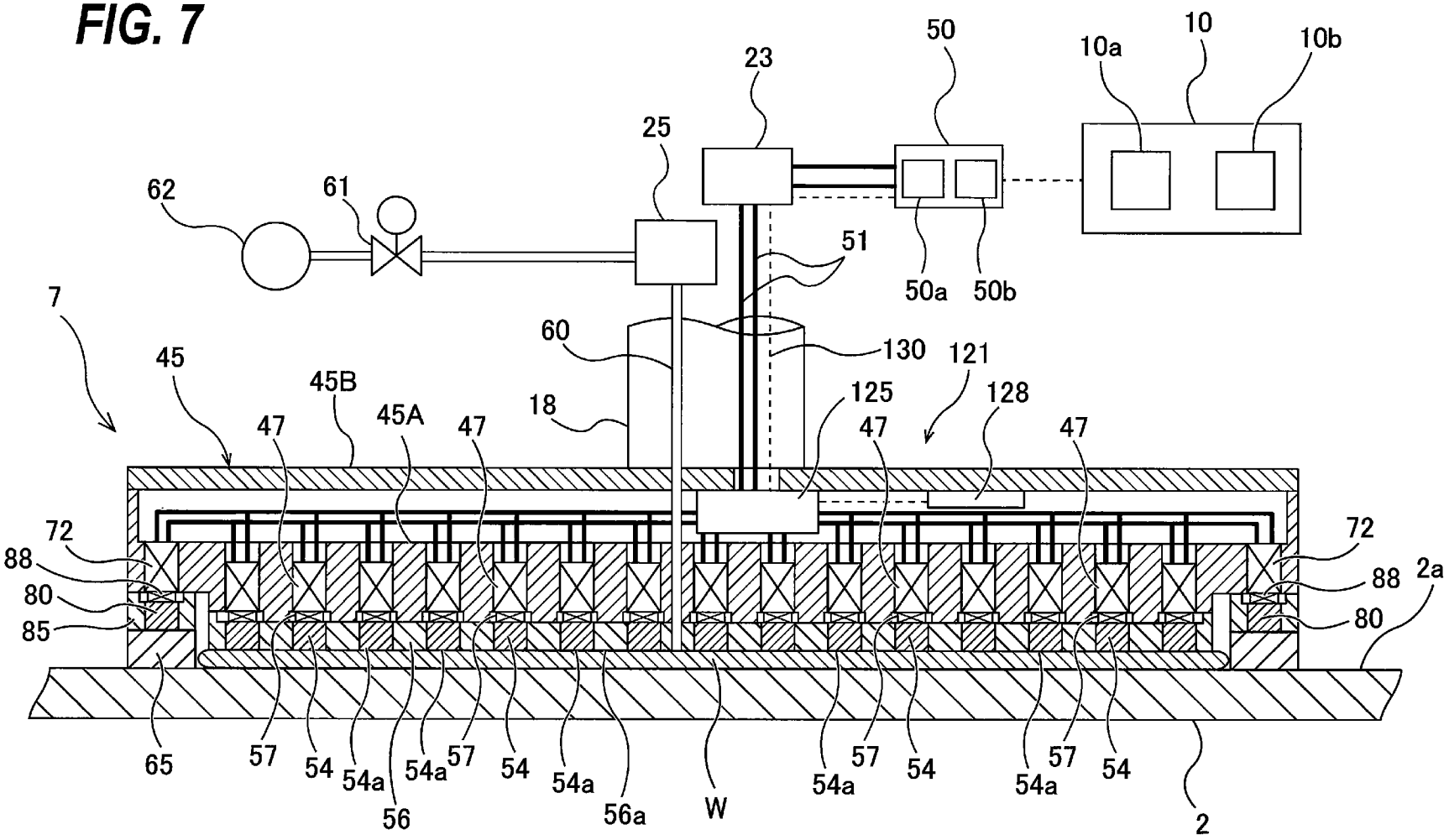
FIG. 7 is a cross-sectional view showing another embodiment of the polishing head system.

FIG. 7 is a cross-sectional view showing another embodiment of the polishing head system. Configurations and operations of this embodiment, which will not be particularly described, are the same as those of the embodiments described with reference to FIGS. 1 to 6, and repetitive descriptions will be omitted.

The polishing head system of this embodiment includes a voltage distributor 121 arranged in the polishing head 7. The voltage distributor 121 includes a branch device 125 configured to distribute the voltage to the piezoelectric elements 47 and 72, and a communication device 128 coupled to the branch device 125. The branch device 125 and the communication device 128 are fixed to the carrier 45. The branch device 125 is electrically coupled to the power supply unit 50*a* of the drive-voltage application device 50 via the power lines 51 and the rotary connector 23. The electric power is supplied to the branch device 125 from the power supply unit 50*a* of the drive-voltage application device 50 through the power lines 51, and further distributed from the branch device 125 to the piezoelectric elements 47 and 72.

The branch device 125 is coupled to the power supply unit 50*a* of the drive-voltage application device 50 via the power lines 51 and the rotary connector 23, so that the electric power is supplied from the power supply unit 50*a* to the branch device 125. The communication device 128 is coupled to the operation controller 10 via a communication line 130. The communication line 130 extends from the communication device 128 to the operation controller 10 via the rotary connector 23 and the voltage controller 50*b*. The operation controller 10 sends the instruction values of the voltage, to be applied to the piezoelectric elements 47 and the piezoelectric elements 72, to the voltage controller 50*b* and the communication device 128. The communication device 128 in turn sends the instruction values of the voltage to the branch device 125. The branch device 125 distributes and applies the voltages, supplied from the power supply unit 50*a*, to the piezoelectric elements 47 and the piezoelectric elements 72 based on the instruction values obtained from the communication device 128 and the instruction values obtained from the voltage controller 50*b*. According to this embodiment, the number of power lines 51 extending from the piezoelectric elements 47 and 72 to the power supply unit 50*a* can be reduced.

Figure 8:
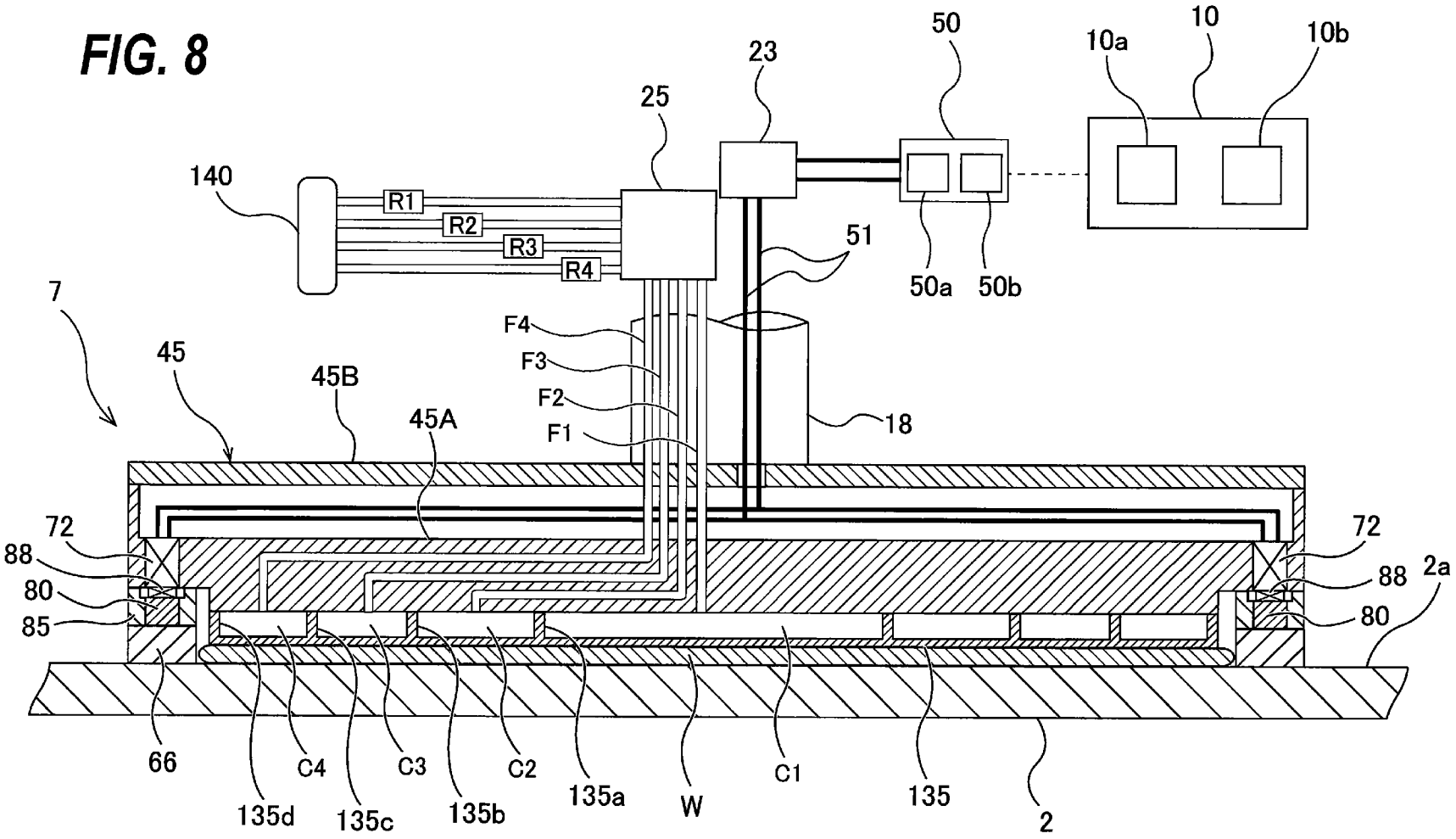
FIG. 8 is a cross-sectional view showing another embodiment of the polishing head system.

FIG. 8 is a cross-sectional view showing another embodiment of the polishing head system. Configurations and operations of this embodiment, which will not be particularly described, are the same as those of the embodiments described with reference to FIGS. 1 to 7, and repetitive descriptions will be omitted.

In the present embodiment, the actuators for pressing the workpiece W against the polishing surface 2*a* of the polishing pad 2 comprise fluid-pressure type actuator, instead of the piezoelectric elements 47. More specifically, the fluid-pressure type actuator includes an elastic membrane 135 forming a plurality of pressure chambers C1 to C4, a plurality of gas supply lines F1 to F4 communicating with the pressure chambers C1 to C4, respectively, and a plurality of pressure regulators R1 to R4 coupled to these gas supply lines F1 to F4, respectively. The elastic membrane 135 has an exposed surface that constitutes a workpiece contact surface for pressing the workpiece W against the polishing surface 2*a* of the polishing pad 2.

The elastic membrane 135 is held on the lower surface of the carrier 45. The elastic membrane 135 has a plurality of concentric partition walls 135*a* to 135*d*. These partition walls 135*a* to 135*d* divide an inside space of the elastic membrane 135 into the pressure chambers C1 to C4. The arrangement of these pressure chambers C1 to C4 is concentric. In this embodiment, four pressure chambers C1 to C4 are provided, while less than four pressure chambers or more than four pressure chambers may be provided. The retainer member 66 is arranged so as to surround the elastic membrane 135 and the pressure chambers C1 to C4.

The gas supply lines F1 to F4 extend to a compressed-gas supply source 140 via the rotary joint 25. The compressed-gas supply source 140 may be a utility facility installed in a factory where the polishing apparatus 1 is installed, or may be a pump configured to deliver a compressed gas. Compressed gas, such as compressed air, is supplied from the compressed-gas supply source 140 into the pressure chambers C1 to C4 through the gas supply lines.

The pressure regulators R1 to R4 are attached to the gas supply lines F1 to F4, respectively, and are configured to independently regulate the pressures of the compressed gas in the pressure chambers C1 to C4. The pressure regulators R1 to R4 are coupled to the operation controller 10, so that the operations of the pressure regulators R1 to R4 (i.e., the pressures of the compressed gas in the pressure chambers C1 to C4) are controlled by the operation controller 10. More specifically, the operation controller 10 sends pressure-instruction values to the pressure regulators R1 to R4, respectively, and the pressure regulators R1 to R4 operate so as to maintain the pressures in the pressure chambers C1 to C4 at the corresponding pressure-instruction values. The polishing head 7 can press different regions of the workpiece W with different pressing forces.

Next, an example of the operation of the polishing head 7 shown in FIG. 8 will be described. The operation controller 10 calculates a difference between a current film-thickness profile of the workpiece W and a target film-thickness profile stored in advance in the memory 10*a*, and creates a distribution of target polishing amounts for the surface, to be polished, of the workpiece W. Further, the operation controller 10 determines instruction values of the voltage to be applied to the piezoelectric elements 72 and instruction values of the pressure to be sent to the pressure regulators R1 to R4 in order to achieve the target polishing amounts within a predetermined polishing time, based on the determined distribution of the target polishing amounts. For example, the operation controller 10 creates a distribution of target polishing rates from the distribution of the target polishing amounts and the above predetermined polishing time, and determines the instruction values of the voltage and the instruction values of the pressure capable of achieving the target polishing rates from a polishing rate correlation data. The polishing rate correlation data includes a data showing a relationship between the polishing rate and the instruction value of the voltage and a data showing a relationship between the polishing rate and the instruction value of the pressure.

The operation controller 10 sends the instruction values of the pressure to the pressure regulators R1 to R4 and sends the instruction values of the voltage to the voltage controller 50*b* of the drive-voltage application device 50. The pressure regulators R1 to R4 operate so as to maintain the pressures in the pressure chambers C1 to C4 at the instruction values of the pressure. The voltage controller 50*b* instructs the power supply unit 50*a* according to the instruction values of the voltage to apply predetermined voltages to the piezoelectric elements 72. In this manner, the polishing head 7 adjust the film-thickness profile of the workpiece W. During polishing of the workpiece W, the film-thickness profile is adjusted, for example, at regular time intervals or at every rotation cycle of the polishing table 5.

In another example of the operation of the polishing head 7, the operation controller 10 may determine, without producing the distribution of the target polishing amounts, the instruction values of the voltage to be applied to the piezoelectric elements 72 and the instruction values of the pressure to be sent to the pressure regulators R1 to R4, based on a current film-thickness profile of the workpiece W obtained by the film-thickness sensor 42. For example, when the target film-thickness profile is a flat film-thickness profile, the operation controller 10 determines an instruction value for applying a voltage higher than a currently-applied voltage by a predetermined amount of change to the piezoelectric element 72 corresponding to a region where the film-thickness index value is large in order to make the current film-thickness profile closer to the flat film-thickness profile. Conversely, the operation controller 10 determines an instruction value for applying a voltage lower than a currently-applied voltage by a predetermined amount of change to other piezoelectric element 72 corresponding to a region where the film-thickness index value is small. Similarly, the operation controller 10 determines an instruction value for creating a pressure higher than a currently-applied pressure by a predetermined amount of change in the pressure chamber corresponding to a region where the film-thickness index value is large in order to make the current film-thickness profile closer to the flat film-thickness profile. Conversely, the operation controller 10 determines an instruction value for creating a pressure lower than a currently-applied pressure by a predetermined amount of change in the other pressure chamber corresponding to a region where the film-thickness index value is small. The amount of change in the voltage and the amount of change in the pressure are set as parameters in advance in the operation controller 10.

The above-described embodiments can be combined as appropriate. For example, the embodiment shown in FIG. 6 can be applied to the embodiment shown in FIG. 7 and the embodiment shown in FIG. 8.

The embodiments can be applied not only to polishing of a circular workpiece, but also to polishing of a polygonal workpiece, such as a rectangular workpiece and a quadrangular workpiece. For example, a polishing head system for polishing a quadrangular workpiece may include a retainer member configured so as to surround the quadrangular workpiece.

Figure 9:
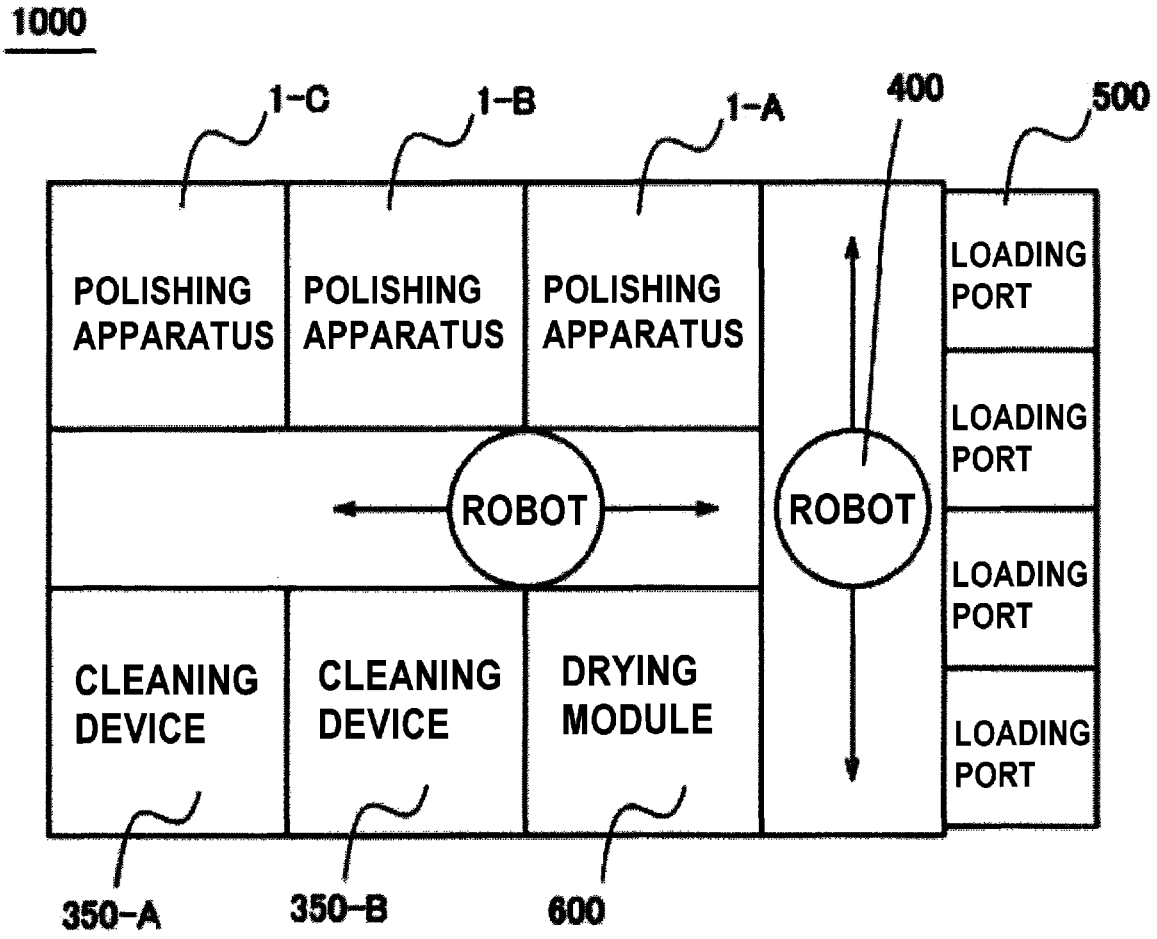
FIG. 9 is a plan view showing an embodiment of a processing system for processing a workpiece.

FIG. 9 is a plan view showing an embodiment of a processing system for processing a workpiece. A processing system 1000 illustrated in the drawing includes polishing apparatuses 1-A to 1-C each for polishing a workpiece W as discussed in this specification, cleaning devices 350-A, 350-B each for cleaning the workpiece W, a robot 400 as a transporting device for the workpiece W, loading ports 500 for the workpiece W. and a drying device 600. In such a system configuration, the workpiece W to be processed is placed in one of the loading ports 500. The workpiece W loaded on the loading port 500 is conveyed by the robot 400 to any of the polishing apparatuses 1-A to 1-C, where the polishing process is performed on the workpiece W. The workpiece W, such as a substrate, may be successively polished by the polishing apparatuses. The polished workpiece W is transported by the robot 400 to any of the cleaning devices 350-A and 350-B, where the workpiece W is cleaned. The workpiece W may be successively cleaned by the cleaning devices 350-A and 350-B. The workpiece W that has been cleaned is transported to the drying device 600, where the drying process is performed on the workpiece W. The dried workpiece W is returned to the loading port 500.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing head system for polishing a workpiece having a film, to be processed, by relatively moving the workpiece and a polishing surface in the presence of a polishing liquid while pressing the workpiece against the polishing surface, comprising:

a polishing head including an actuator configured to apply a pressing force to the workpiece, a retainer member arranged outside the actuator, and first piezoelectric elements coupled to the retainer member, a carrier having multiple stepped portions which are in contact with the first piezoelectric elements to fix positions of first piezoelectric elements, and pressing-force measuring devices configured to measure pressing forces generated by the first piezoelectric elements, the pressing-force measuring devices being disposed between the multiple stepped portions and the retainer member; and a drive-voltage application device configured to apply voltages independently to the first piezoelectric elements.

2. The polishing head system according to claim 1, wherein the retainer member comprises retainer members coupled to the first piezoelectric elements, respectively.

3. The polishing head system according to claim 1, further comprising a retainer-member moving device configured to move an entirety of the first piezoelectric elements and the retainer member toward the polishing surface.

4. The polishing head system according to claim 3, wherein the retainer-member moving device includes an elastic bag forming a first pressure chamber therein and a first gas supply line communicating with the first pressure chamber.

5. The polishing head system according to claim 1, wherein:

the polishing head further includes coupling members coupled to the first piezoelectric elements, respectively; and end surfaces of the coupling members are coupled to the retainer member.

6. The polishing head system according to claim 5, wherein the polishing head further includes a first holding member configured to limit a range of movement of the coupling members in a direction perpendicular to a direction of pressing the retainer member.

7. The polishing head system according to claim 6, wherein each of the coupling members has an upper protrusion, a lower protrusion, and a body portion located between the upper protrusion and the lower protrusion, a width of the body portion is smaller than widths of the upper protrusion and the lower protrusion, the holding member has a supporting portion that movably supports the body portion.

8. The polishing head system according to claim 1, wherein the pressing-force measuring devices are arranged between the multiple stepped portions and the coupling members, respectively.

9. The polishing head system according to claim 1, wherein the polishing head further includes a voltage distributor electrically coupled to the drive-voltage application device and the first piezoelectric elements, the voltage distributor being configured to distribute the voltage applied from the drive-voltage application device to the first piezoelectric elements.

10. The polishing head system according to claim 1, wherein the actuator comprises a fluid-pressure type actuator, the fluid-pressure type actuator including an elastic membrane configured to form second pressure chambers and arranged to contact the back surface of the workpiece, and second gas supply lines communicating with the second pressure chambers, respectively.

11. The polishing head system according to claim 1, wherein the actuator comprises second piezoelectric elements which are arranged so as to apply pressing forces to multiple regions of the workpiece.

12. The polishing head system according to claim 11, wherein the polishing head further includes pressing members coupled to the second piezoelectric elements, respectively.

13. The polishing head system according to claim 12, wherein the polishing head further includes a second holding member configured to limit a range of movement of the pressing members in a direction perpendicular to a direction of pressing of the workpiece.

14. The polishing head system according to claim 11, wherein the second piezoelectric elements are electrically coupled to a voltage distributor which is configured to distribute the voltage applied from the drive-voltage application device to the second piezoelectric elements.

15. A polishing apparatus for polishing a workpiece, comprising:

a polishing table for holding a polishing pad;

a polishing-liquid supply nozzle configured to supply a polishing liquid onto the polishing pad;

a polishing head system; and an operation controller configured to control operations of the polishing table, the polishing-liquid supply nozzle, and the polishing head system, the polishing head system including:

a polishing head including an actuator configured to apply a pressing force to the workpiece, a retainer member arranged outside the actuator, and first piezoelectric elements coupled to the retainer member, a carrier having multiple stepped portions which are in contact with the first piezoelectric elements to fix positions of first piezoelectric elements, and pressing-force measuring devices configured to measure pressing forces generated by the first piezoelectric elements, the pressing-force measuring devices being disposed between the multiple stepped portions and the retainer member; and a drive-voltage application device configured to apply voltages independently to the first piezoelectric elements.

16. The polishing apparatus according to claim 15, further comprising a film-thickness sensor configured to measure a thickness of a film, to be processed, of the workpiece, the film-thickness sensor being arranged in the polishing table.

17. The polishing apparatus according to claim 16, wherein the operation controller is configured to produce a film-thickness profile of the workpiece from measured values of the film thickness acquired by the film-thickness sensor, and to determine voltage instruction values for the drive-voltage application device based on the film-thickness profile.

18. The polishing apparatus according to claim 16, wherein the operation controller is configured to determine voltage instruction values for the drive-voltage application device based on a difference between the film-thickness profile and a target film-thickness profile.

19. The polishing apparatus according to claim 15, further comprising a loading and unloading device configured to allow the polishing head to hold the workpiece thereon.

20. The polishing apparatus according to claim 15, further comprising an orientation detector configured to detect an orientation of the workpiece in its circumferential direction.

21. A processing system for processing a workpiece, comprising:

the polishing apparatus according to claim 15 for polishing the workpiece;

a cleaning device configured to clean the polished workpiece;

a drying device configured to dry the cleaned workpiece; and a transporting device configured to transport the workpiece between the polishing apparatus, the cleaning device, and the drying device.

* * * * *